US006569006B1

(12) United States Patent
Kurosawa et al.

(10) Patent No.: US 6,569,006 B1
(45) Date of Patent: May 27, 2003

(54) HORIZONTAL-TYPE COIN HOPPER

(75) Inventors: Motoharu Kurosawa, Iwatsuki (JP); Yorio Suzukawa, Iwatsuki (JP); Takako Sakai, Iwatsuki (JP)

(73) Assignee: Asahi Seiko Kabushiki Kaisha (JP)

( * ) Notice: Subject to any disclaimer, the term of this patent is extended or adjusted under 35 U.S.C. 154(b) by 0 days.

(21) Appl. No.: 09/632,335

(22) Filed: Aug. 3, 2000

(30) Foreign Application Priority Data

Aug. 6, 1999 (JP) ..... 11-223480
Jun. 21, 2000 (JP) ..... 2000-185529

(51) Int. Cl.[7] ..... G07D 1/00
(52) U.S. Cl. ..... 453/57; 453/33; 453/13; 453/49
(58) Field of Search ..... 453/57

(56) References Cited

U.S. PATENT DOCUMENTS 3,667,484 A * 6/1972 Reis ..... 312/126
3,942,544 A * 3/1976 Breitenstein et al. ..... 133/4 R
3,948,280 A * 4/1976 Dahl et al. ..... 453/57
4,148,331 A 4/1979 Nicolaus
4,557,282 A 12/1985 Childers et al.
4,574,824 A * 3/1986 Paulsen et al. ..... 133/4 R
4,752,274 A * 6/1988 Abe ..... 453/32
4,798,558 A * 1/1989 Bellis ..... 453/32
4,810,230 A * 3/1989 Shirasawa ..... 453/57
4,821,920 A * 4/1989 Lin et al. ..... 198/397.05
4,822,318 A * 4/1989 Okada ..... 454/57
5,055,086 A * 10/1991 Rateman et al. ..... 453/10
5,098,339 A * 3/1992 Dabrowski ..... 221/203
5,141,443 A * 8/1992 Rasmussen et al. ..... 453/10
5,152,716 A 10/1992 Abe
5,190,495 A * 3/1993 Taxon ..... 453/29
5,195,626 A * 3/1993 Le Hong et al. ..... 194/317
5,282,769 A * 2/1994 Suzukawa ..... 453/49
5,285,883 A * 2/1994 Le Hong ..... 194/317
5,295,900 A * 3/1994 Tsuchida et al. ..... 221/203
5,316,517 A * 5/1994 Chiba et al. ..... 221/203

(List continued on next page.)

FOREIGN PATENT DOCUMENTS

EP 0 450 918 A2 10/1991
JP 56-53247 5/1981
JP 03158991 A * 7/1991 ..... 453/57
JP 4-45085 10/1992
JP 8-110960 4/1996
JP 9-35107 2/1997
JP 10-208099 8/1998

*Primary Examiner*—Donald P. Walsh
*Assistant Examiner*—Jeffrey A. Shapiro
(74) *Attorney, Agent, or Firm*—McGlew and Tuttle, P.C.

(57) ABSTRACT

A horizontal disk-type coin hopper is provided that reduces the propensity for coins to be standing on the rotating disk and improves coin pickup. The hopper prevents coin bridging and the coin interlocking phenomenon in a hopper tank. The coin hopper includes the tank with a pot shape for storing a plurality of coins and the disk (52) which is positioned substantially horizontally at the inner bottom of the tank. The disk rotates freely. A hole is opened in the disk and provides a passage for coins positioned in a horizontal state. The hopper has a mechanism for releasing coins with a stirring body (10) which is on the top surface of the disk and is arranged on the turn center position of the disk.

7 Claims, 16 Drawing Sheets

U.S. PATENT DOCUMENTS

RE34,934 E * 5/1995 Raterman et al. ..... 453/10
5,512,016 A * 4/1996 Tani ..... 453/32
5,530,730 A * 6/1996 Takemoto et al. ..... 377/5
5,616,074 A * 4/1997 Chen ..... 453/30
5,695,395 A 12/1997 Ota et al.
5,695,399 A 12/1997 Ota et al.
5,810,230 A 9/1998 Nutto
5,897,024 A * 4/1999 Coughlin et al. ..... 221/135
5,924,919 A * 7/1999 Hirano ..... 453/57
5,964,657 A * 10/1999 Abe et al. ..... 453/3
5,984,771 A * 11/1999 Abe ..... 453/17
6,039,166 A * 3/2000 Abe et al. ..... 194/317
6,085,938 A * 7/2000 Coughlin ..... 221/203
6,093,094 A * 7/2000 Uecker et al. ..... 194/346
6,168,513 B1 * 1/2001 Souza et al. ..... 453/57
6,193,599 B1 * 2/2001 Kurosawa et al. ..... 453/57
6,210,264 B1 * 4/2001 Richardson ..... 453/57
6,261,170 B1 * 7/2001 Bell et al. ..... 194/344
6,273,809 B1 * 8/2001 Bell et al. ..... 453/57

* cited by examiner

PRIOR ART FIG. 8

HORIZONTAL-TYPE COIN HOPPER

FIELD OF THE INVENTION

The invention relates to hopper equipment for compulsorily releasing a plurality of coins one by one and more particularly, the invention concerns coin hopper equipment for releasing a plurality of coins stored in a loose condition with a tank, which constitutes an upper part of hopper equipment, for storing a plurality of coins in a loose condition. The terminology "coin" used in this specification relates to a disk like element including a coin which is currency as well as disks such as medals and tokens, etc. used for game machines.

BACKGROUND OF THE INVENTION

Various coin hopper machines have been developed. For example, coin issuing equipment has been shown in Japanese Patent Application No. 6-281113 by this applicant of the present application. Japanese Patent Application No.6-281113 laid-opened as a patent publication as Japanese Patent Disclosure No.8-110960 discloses hopper equipment which is similar to the above-mentioned coin issuing equipment. Referring to FIGS. 7 and 8, this hopper equipment has a pot-shaped tank 31 for containing a plurality of coins in a loose condition. This tank 31 is a molded product formed of synthetic resin. Opening 32, which is at an upper part of tank 31, is formed as a large square ring shape. Opening 33, which is at a lower part of tank 31, is formed in a little small circular ring shape. Between these openings 32 and 33, slope division 34 is formed integrally like a pot base. On a lower edge of inner wall of bottom opening 33, groove 35 is formed along all circumferential surfaces (refer to FIG. 8). Then, along this groove 35, a circular disk 41 is mounted freely rotatable. In other words, circular disk 41 closes bottom opening 33 of tank 31rotation-freely. Disk 41 is a member which issues a plurality of coins C one by one from tank 31, as described later. At a part of groove 35, an exit 36 of coin C is formed and communicates to the outside. That is to say, by notching a part of opening 33 which forms groove 35, exit 36 of coin C is formed. Rotating shaft 42 is intruded into disk 41 at the center (refer to FIG. 8). Disk 41 is rotated by this rotating shaft 42. In addition, on whole disk 41, coin catching holes 43 are formed in circumferential and at regular intervals.

On the underside of disk 41, nails 44 for issuing coin C out of exit 36 are formed (refer to FIG. 8). A boxy member shown in FIGS. 7 and 8 is a base mount equipment 45. In this base mount equipment 45, gear train and an electric motor, etc. for driving rotating shaft 42 are stored (not shown).

On the lower edge of bottom opening 33, triangle flanges 37 are formed at the outside (refer to FIG. 7). On these flanges 37, shaped holes or keyholes 38 are provided. Headed shafts (not shown) are inserted on base mount equipment 45. Thus, with existing keyholes 38 and headed shafts, tanks 31 is installed on base mount equipment 45. In the example shown in FIGS. 7 and 8, coins C fall and pile up in holes 43. When disk 41 is rotated, most lower coins C are caught in catching hole 4 is slide and are moved on the upper surface of base mount equipment 45 by means of nail 44. Then and finally, coin C is guided by regulation pin (not shown) and will be discharged from exit 36 to the equipment outside. However, in the above-mentioned prior art, there was a defect in which coins C did not fall in catching holes 43, since there was the height 3H (see FIG. 8) in bottom opening 33 of tank 31. There was a problem in which a large number of coins C were standing in a stabilized position, since the height 3H of tank inner wall 39 which surrounded disk 41 was large (see FIG. 8).

When a plurality of coins C are standing stabilized on the disk 41, this is referred to herein as a "coin train" (see FIG. 8). When a plurality of coins C are stacked and stabilized on the disk 41, this is referred to herein as a "coin column" (not shown). Also, a combination of a coin train and a coin column may also form on the disk 41.

An invention which solved this defect is disclosed in Japanese Patent Application No.9-36832 in the name of the present applicant. Japanese Patent Application No.9-36832 laid-open in patent publication as Japanese Patent Disclosure No.10-208099. The invention of Japanese Patent Application No.9-36832 relates to a fact that if height 3H of tank inner wall 39 which surrounded disk 41 was made small a coin C would not stand up. However, there occurred the problem that coin pickup was poor, when the height of tank bottom wall which surrounded coin extrusion disk was made small. When the height of tank bottom wall which surrounded the disk was made small, there occurred a problem that coins danced and did not fall into catching hole of this disk. Especially, when the number of coins in the tank decreases, there was a problem that the coins greatly danced, since the tank bottom wall did not have sufficient height.

SUMMARY AND OBJECTS OF THE INVENTION

It is an object of the invention to provide a hopper which avoids problems of the prior art and reduces coin dancing as and improves coin pickup.

It is an object of the present invention to prevents the standing condition of a large number of coins and prevents the dancing of a small number of coins. In the first embodiment, comparatively small coins were used, coins with diameter of about 25 millimeters were used. In the second embodiment 2, comparatively large coins are used, coins with diameter of about 30 millimeters were used in the second embodiment. Similarly, in a third embodiment, comparatively large coins are used, coins with diameter of about 30 millimeters were used in the third embodiment 3.

According to the invention, coin hopper equipment is provided comprising at least a tank with an almost pot shape for storing a plurality of coins and a freely rotatable disk provided on the inner bottom of the tank. The height of bottom wall of the tank in which the disk is arranged freely rotatably has level differences. The coin hopper equipment height of bottom wall in the tank may have two large and small level differences. The large height part of the bottom wall in the tank may be about 1/12 or more of the whole bottom wall.

According to another aspect of the invention a coin hopper equipment comprises a tank with a pot shape for storing a plurality of coins and a disk which is located in horizontal at the inner bottom of the tank and provided freely rotatably. A hole is opened in the disk and forms a passage for passing the coins in a horizontal state. A stirring body is provided on the top surface of the disk and arranged on the turn center position of the disk.

The surface of the stirring body may have a frictional surface. The stirring body may be fixed on the disk. The stirring body may be freely rotatably mounted on the disk. The stirring body may be braked by a brake device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
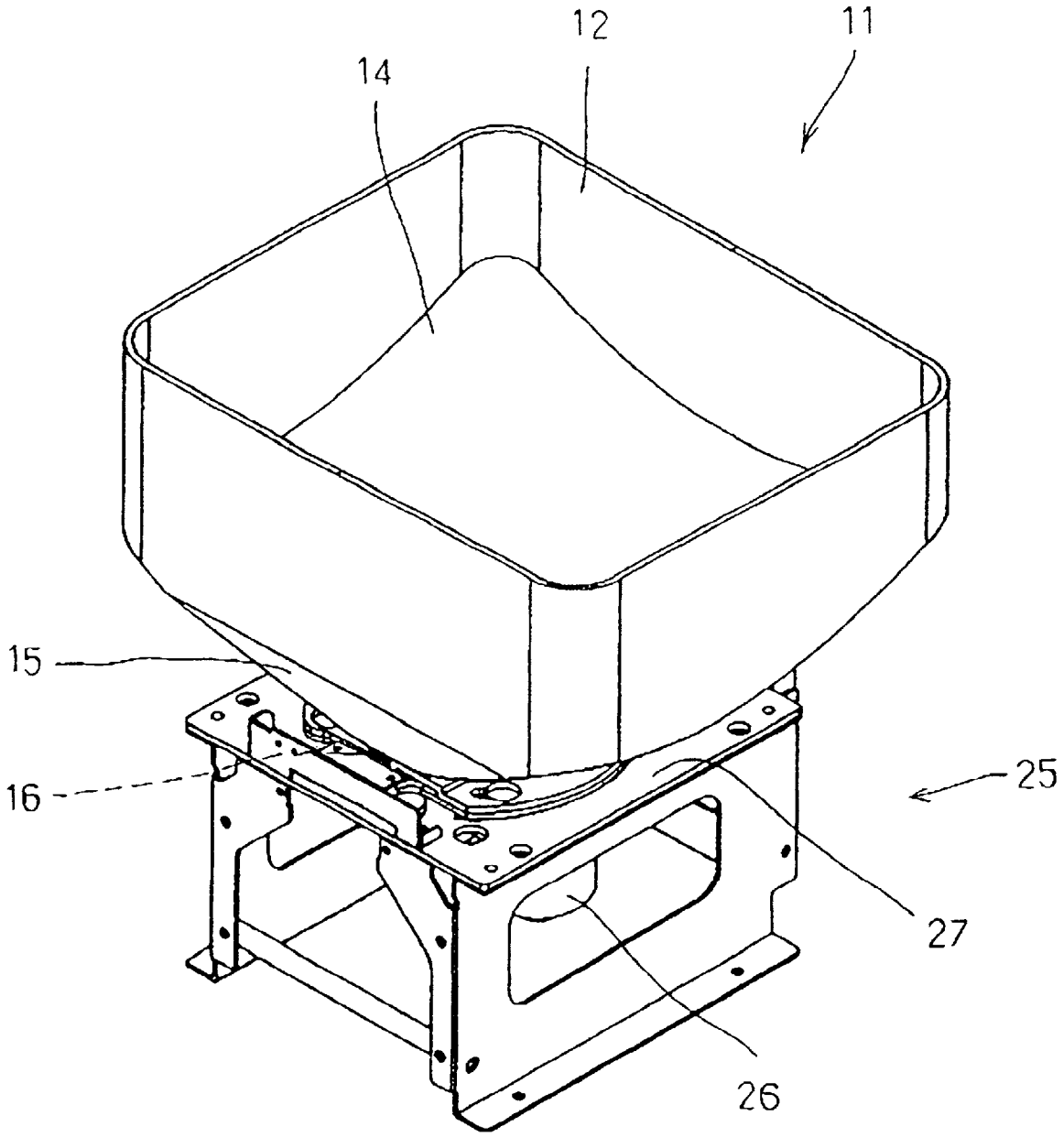
FIG. 1 is a perspective view which summarily shows an embodiment 1 according to the invention.

Referring to the drawings in particular, the embodiment which is shown in FIG. 1 is characterized by a tank 11 which becomes has an almost pot shape for containing a large number of coins in a bulk condition. This tank 11 is a molded product of synthetic resin. An opening 12 which is an upper part of tank 11 is a large angle barrel shape. An opening 13 which is a lower part of tank 11 is a small circular ring shape. Between these top and bottom openings 12 and 13, slope divisions 14 and 15 are provided as a part of the pot base, formed integrally therewith.

Figure 2:
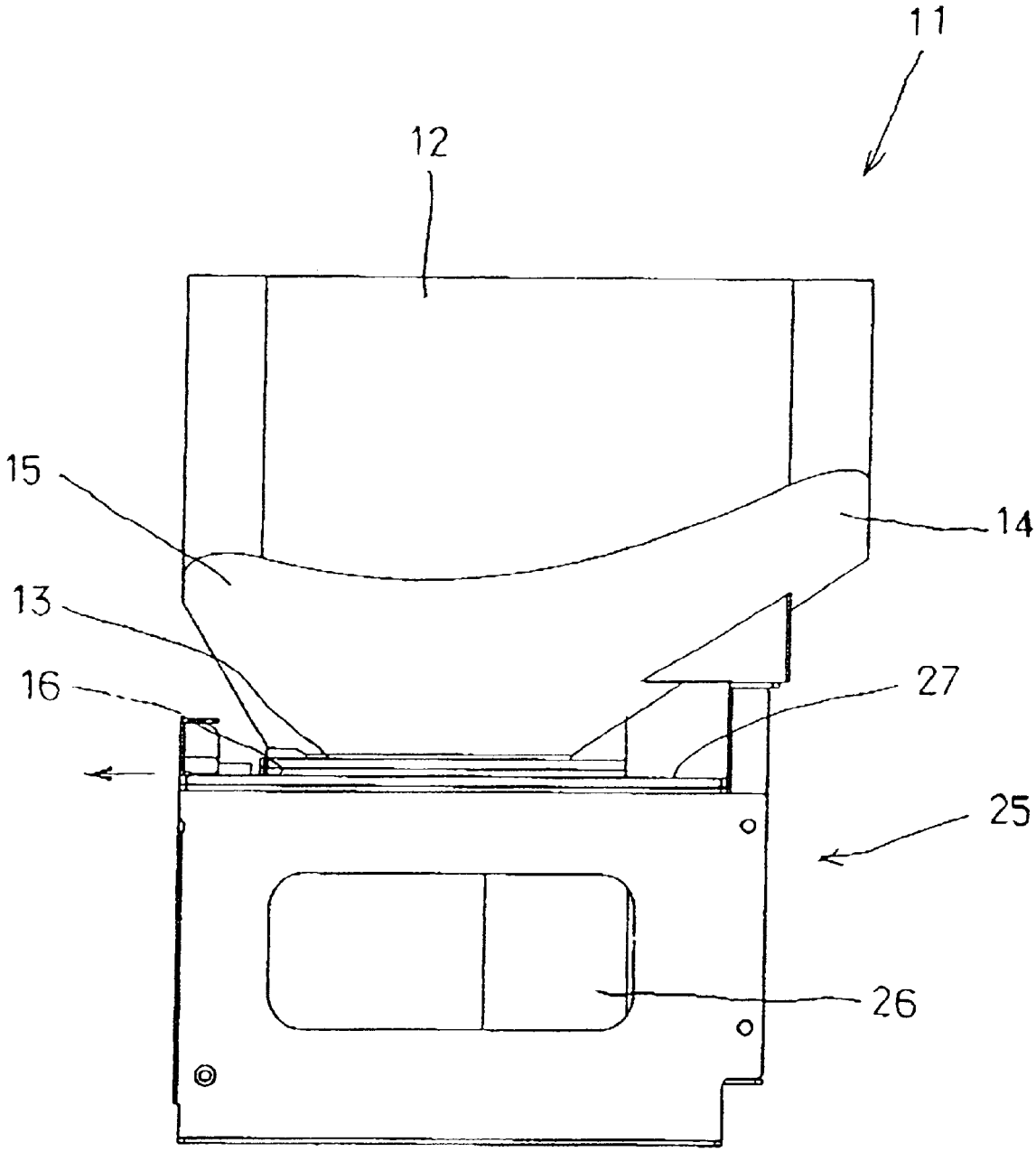
FIG. 2 is a right side view of the device shown in FIG. 1.
Figure 3:
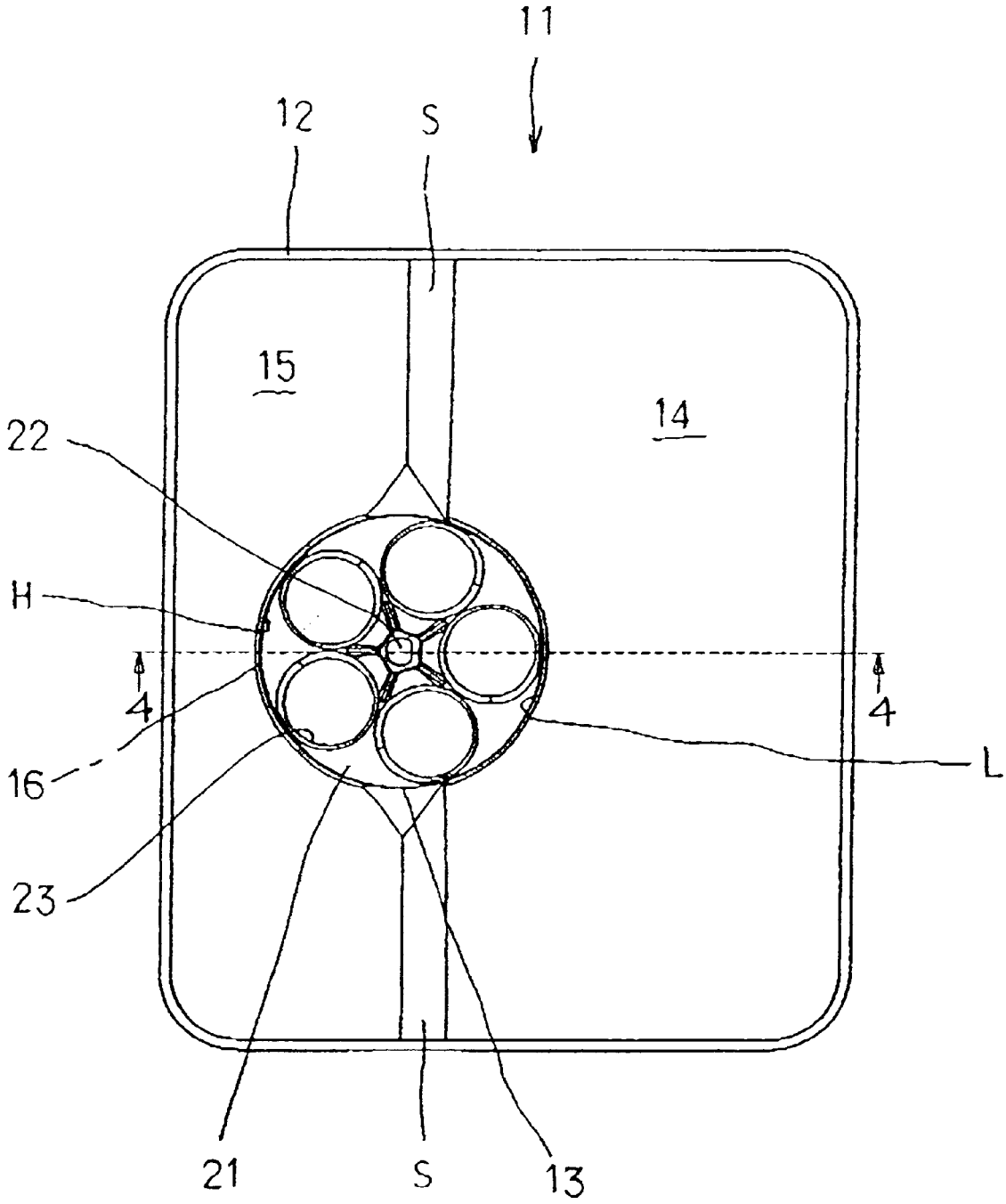
FIG. 3 is a plan view of the device shown in FIG. 1.

Opening 13 of the internal base is provided with a circular disk 21. Disk 21 is mounted freely rotatable (see FIG. 3). In other words, bottom opening 13 is closed by the freely rotatable disk 21. Disk 21 is for issuing, by pushing out, each one of coins to the outside of tank 11, as described later. At the bottom opening 13 a coin exit 16 is communicatively formed. Coin exit 16 is formed by notching a part of bottom opening 13 (see FIG. 2). Rotating shaft 22 is intruded into the center of disk 21 (refer to FIG. 3). Disk 21 is rotated by this rotating shaft 22. In addition, in whole disk 21, coin catching holes 23 are formed in circumferential regular-intervals. On the underside of disk 21, nails or protuberances 24, for urging a coin to exit 16, are formed (refer to FIG. 4).

Figure 4:
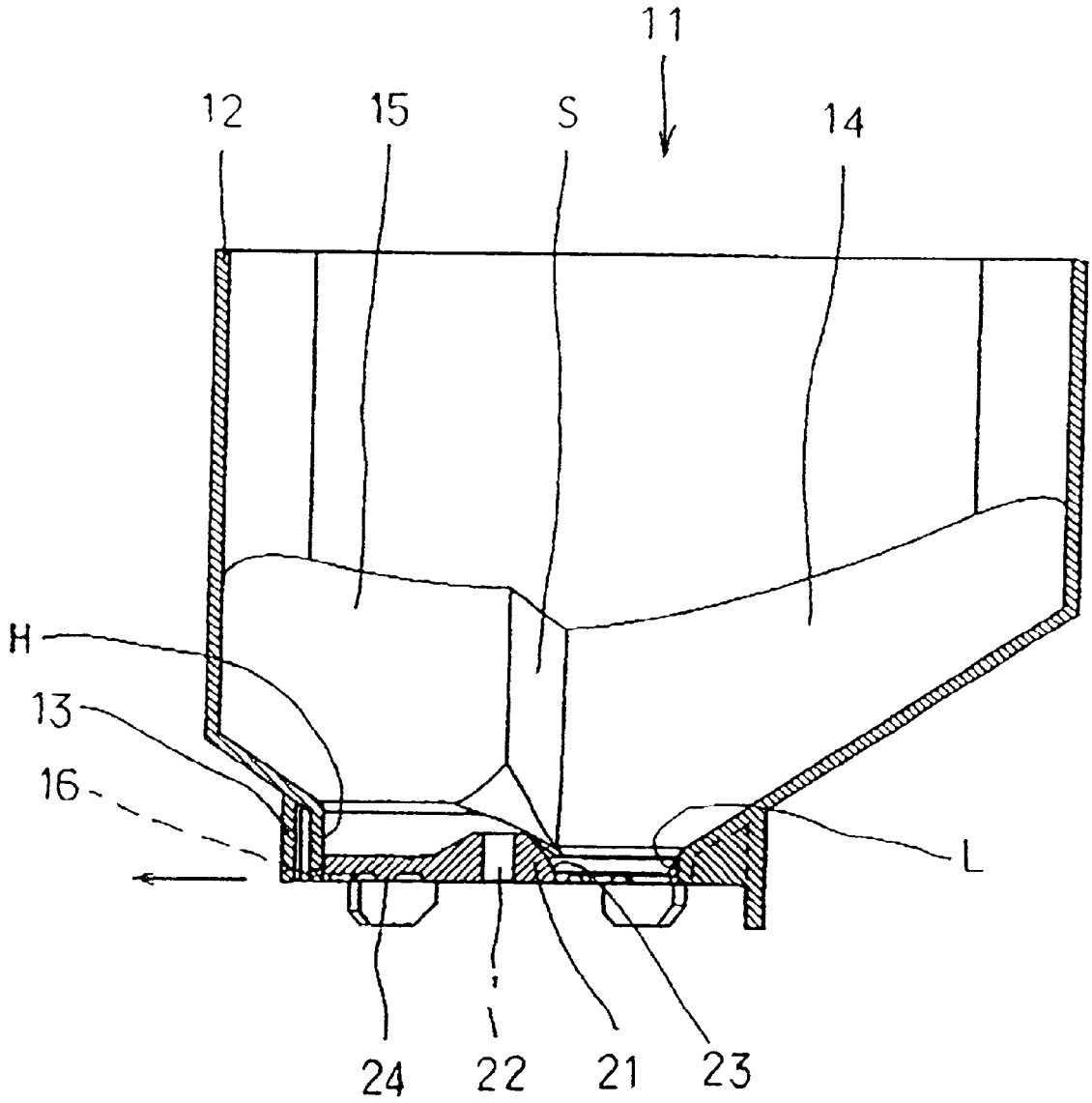
FIG. 4 is an enlarged cross sectional view taken along line 4—4 of FIG. 3.
Figure 5:
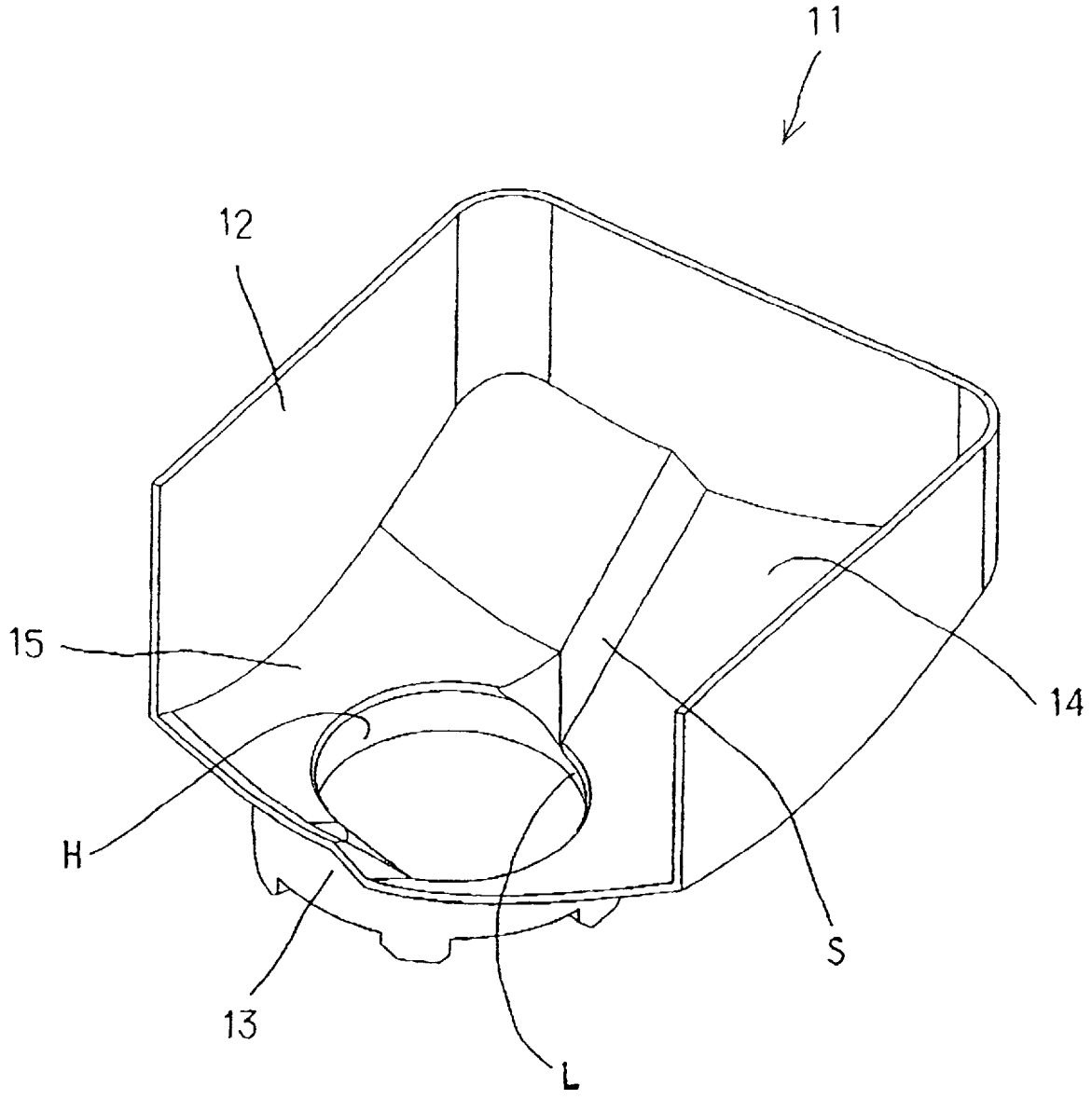
FIG. 5 is a cutaway perspective view which shows a main section of the part shown in FIG. 3.

At the inner circumferential surface wall of bottom opening 13, a part wall near exit 16 is formed as a high wall H and the remainder part wall is formed as a low wall L (refer to FIG. 4). In this practical example, half of the inner circumferential surface wall of bottom opening 13 is formed with the high wall H and another half is formed with the low wall L. In other words, within 360 degrees of circumference wall of bottom opening 13, high wall H occupies 180 degrees. Still, high wall H is formed integrally with narrow slope division 15, and low wall L is formed integrally with wide slope division 14. This provides level difference division S with two slope divisions 14 and 15 formed integrally.

A boxy member which is shown in FIG. 1 below is a base mount equipment 25. In this base mount equipment 25, an electric motor 26 and gear train, etc. (not shown) for driving rotating shaft 22, are located.

In the above-mentioned practical example, coins fall and pile up in catching hole 23, when disk 21 is rotated. The most bottom coin of overlapped coins slides and is moved on upper surface 27 of base mount equipment 25, by protuberance 24. Then, with guidance by regulation pins (not shown), the coin will be released from exit 16 to the equipment outside (refer to the arrow in FIG. 2). In accordance with this practical example, the coin will be smoothly paid out from exit 16, even if coins in tank 11 inside are large in quantity. That is to say, in this practical example, a large number of coins that stand are not stabilized, since about half of inner circumference wall of bottom opening 13 is low wall L. For example, about ⅕ or less of the coin diameter is a desirable dimension for the height of low wall L from disk 21. In this case, since a large number of coins do not stand up and topple down, coins fall into catching holes 23 and then are smoothly paid out into exit 16. And, in accordance with this practical example, the coin will be smoothly paid out from exit 16, even if coins in tank 11 are small in quantity. In this practical example, coins do not dance greatly, since about half of the inner circumference wall of bottom opening 13 is high wall H. For example, about ½ or more of the coin diameter is a desirable for the height of high wall H from this disk 21.

Figure 6:
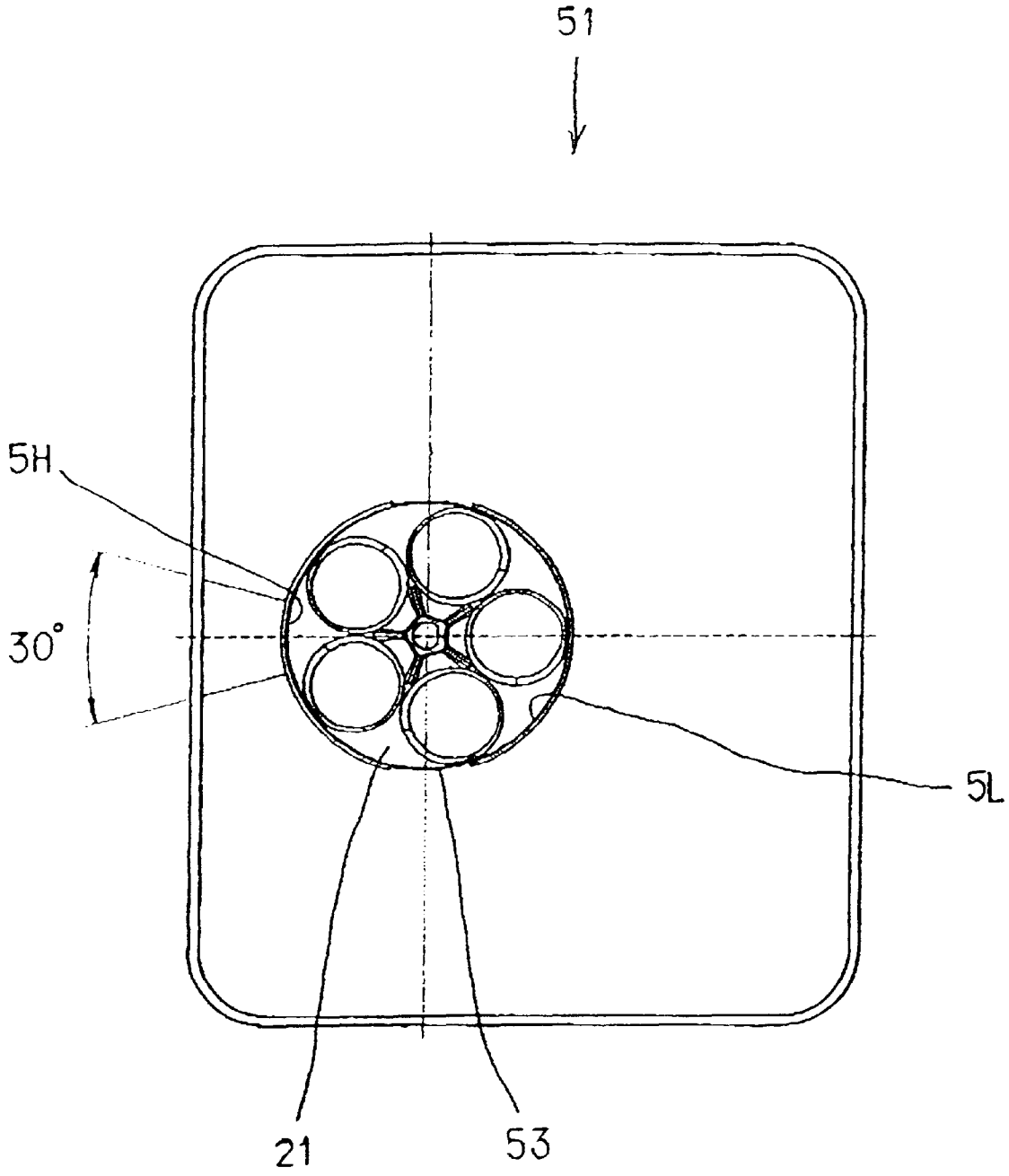
FIG. 6 is a plan view which summarily shows another embodiment according to this invention.
Figure 7:
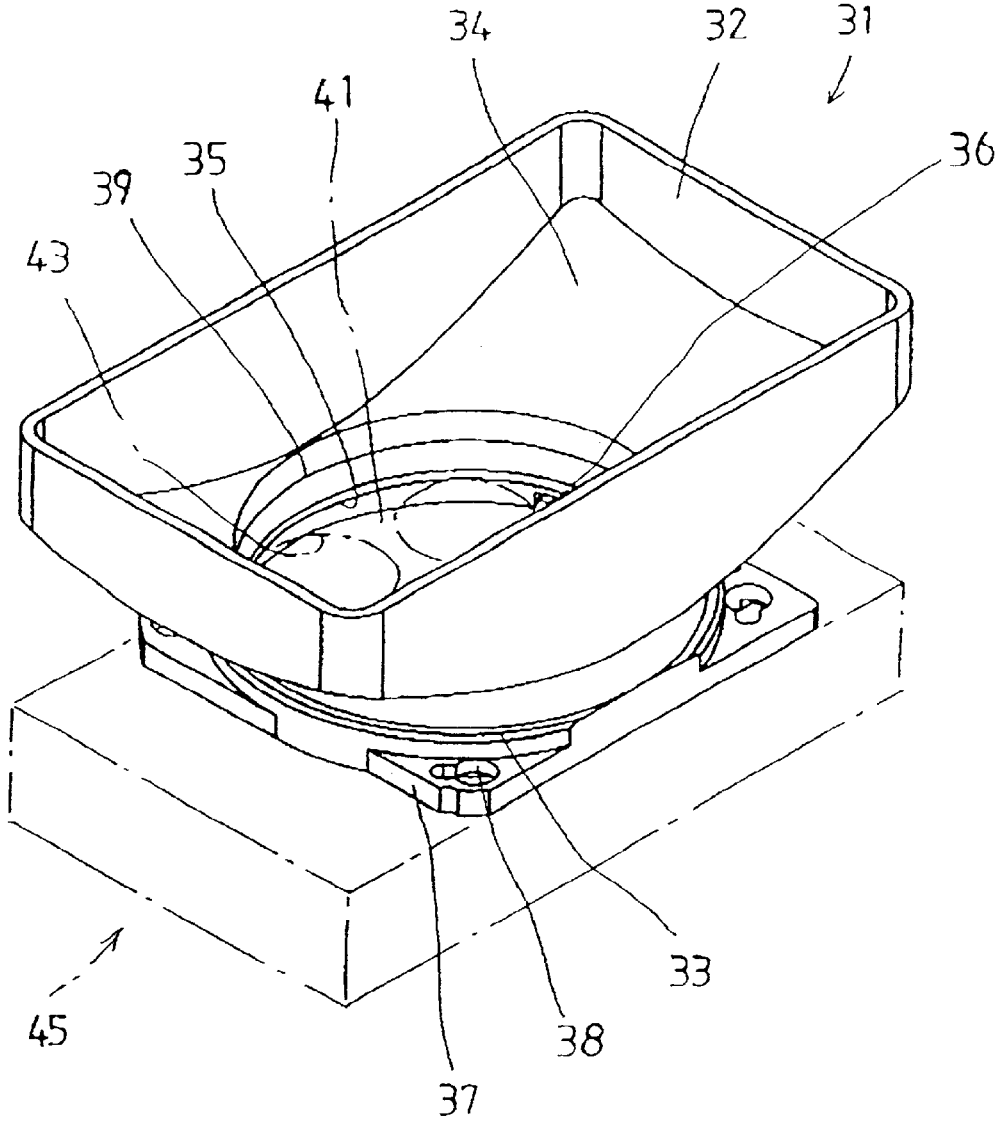
PRIOR ART FIG. 7
FIG. 7 is a perspective view which summarily shows a prior art device.
Figure 8:
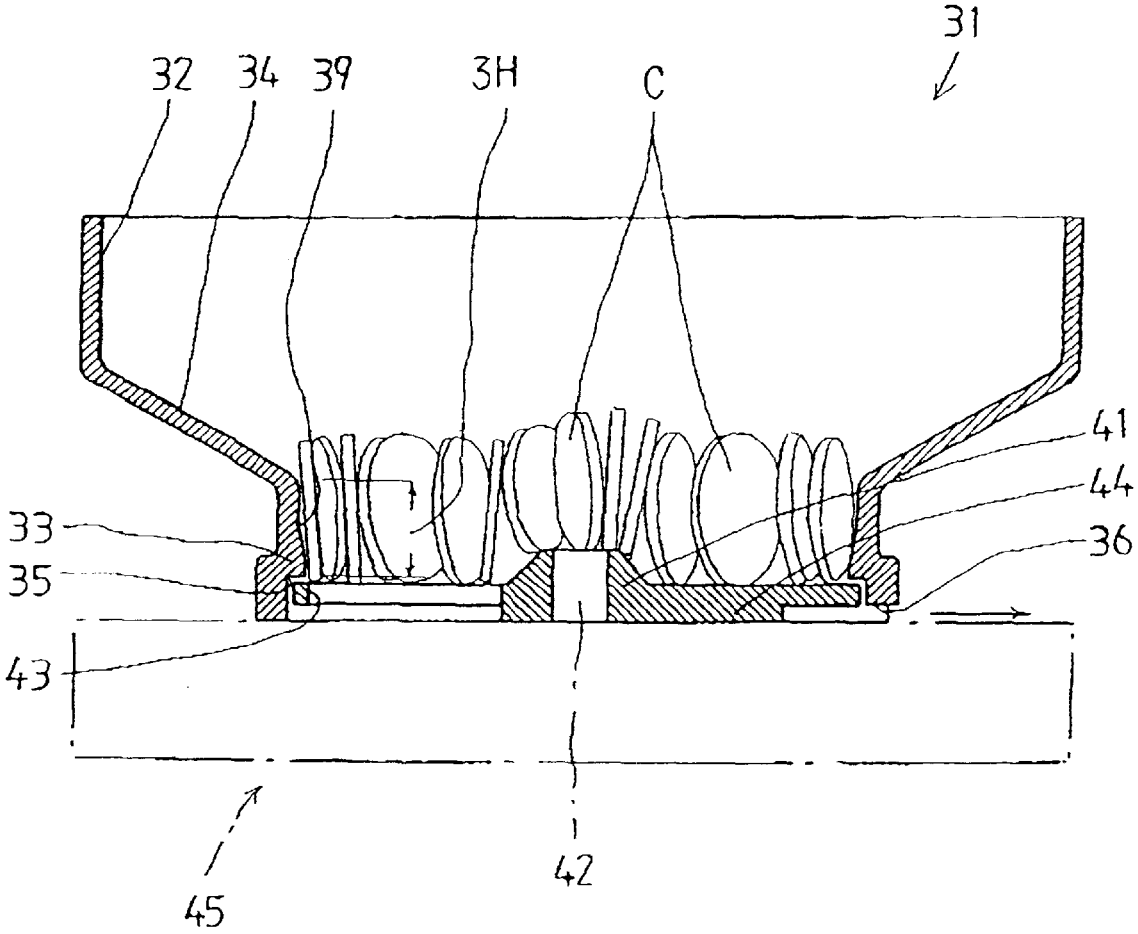
FIG. 8 is a summary sectional view of the device shown in FIG. 7.

A tank 51 is shown in FIG. 6 as a second practical example. This tank 51 has a high wall 5H which may be about 1/12 of an inner circumferential wall of the bottom opening 53. The dancing of coins decreases, even if a high wall 5H occupies 30 degrees within 360 degrees of a circumferential wall of bottom opening 53. Though it is also based on coin size, high wall H can occupy a range of 30 degrees to 330 degrees within 360 degrees of the whole circumference wall.

In proportion to this, low wall L will be able to occupy a range of 30 degrees to 330 degrees within 360 degrees of whole circumference wall. In this practical example, though two kinds of high wall H and low wall L are chosen, it is of course advantageous that a third middle wall is formed. As described above, by addition of simple composition, it is possible that this invention smoothly discharges all of a large number of coins in tank and can discharge the last one of coins. There is a reduction of coin dance of coins, which improves the pickup efficiency of coins is obtained by this invention.

Figure 9:
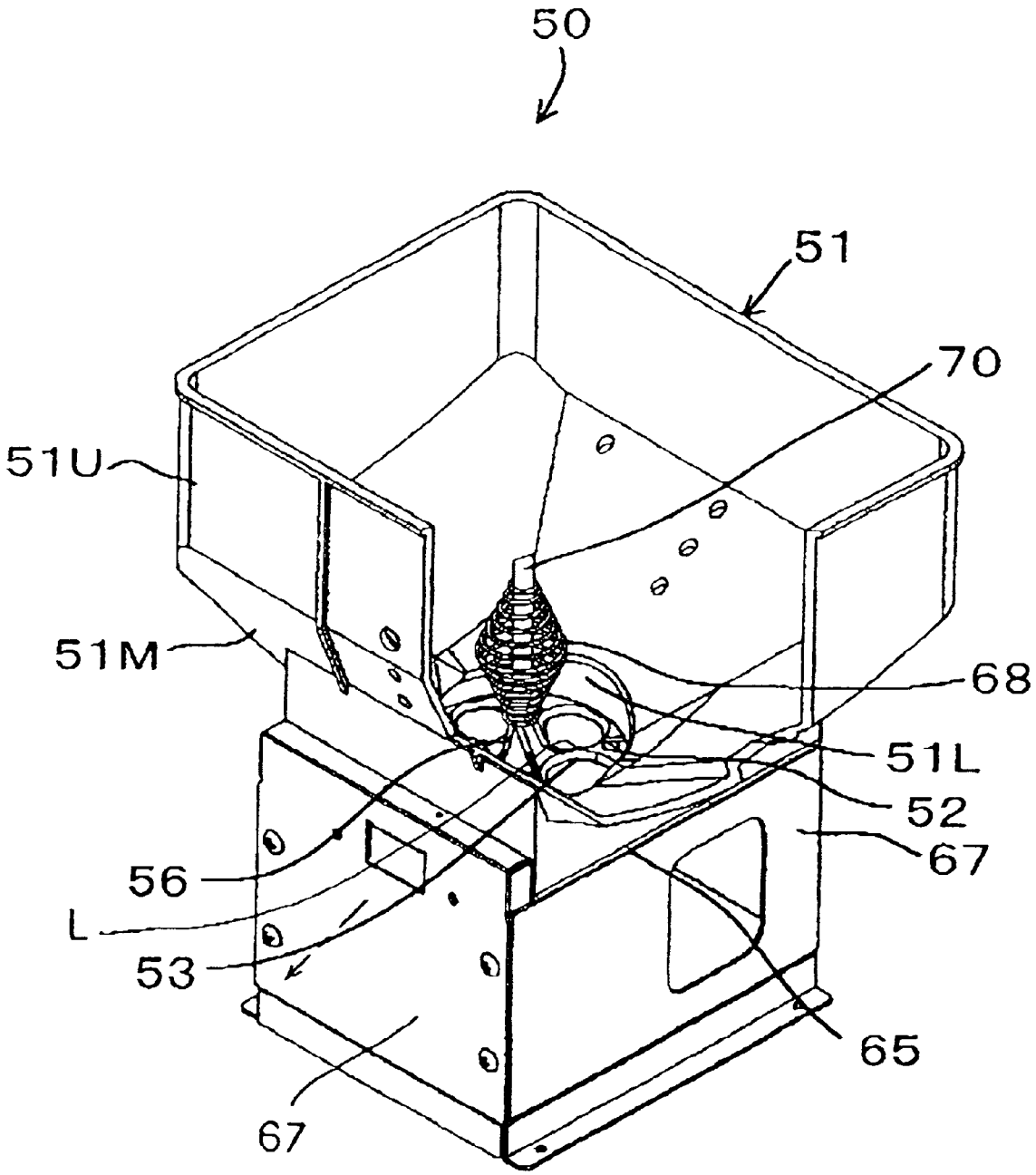
FIG. 9 is a perspective cutaway view which shows a second embodiment according to the invention.
Figure 10:
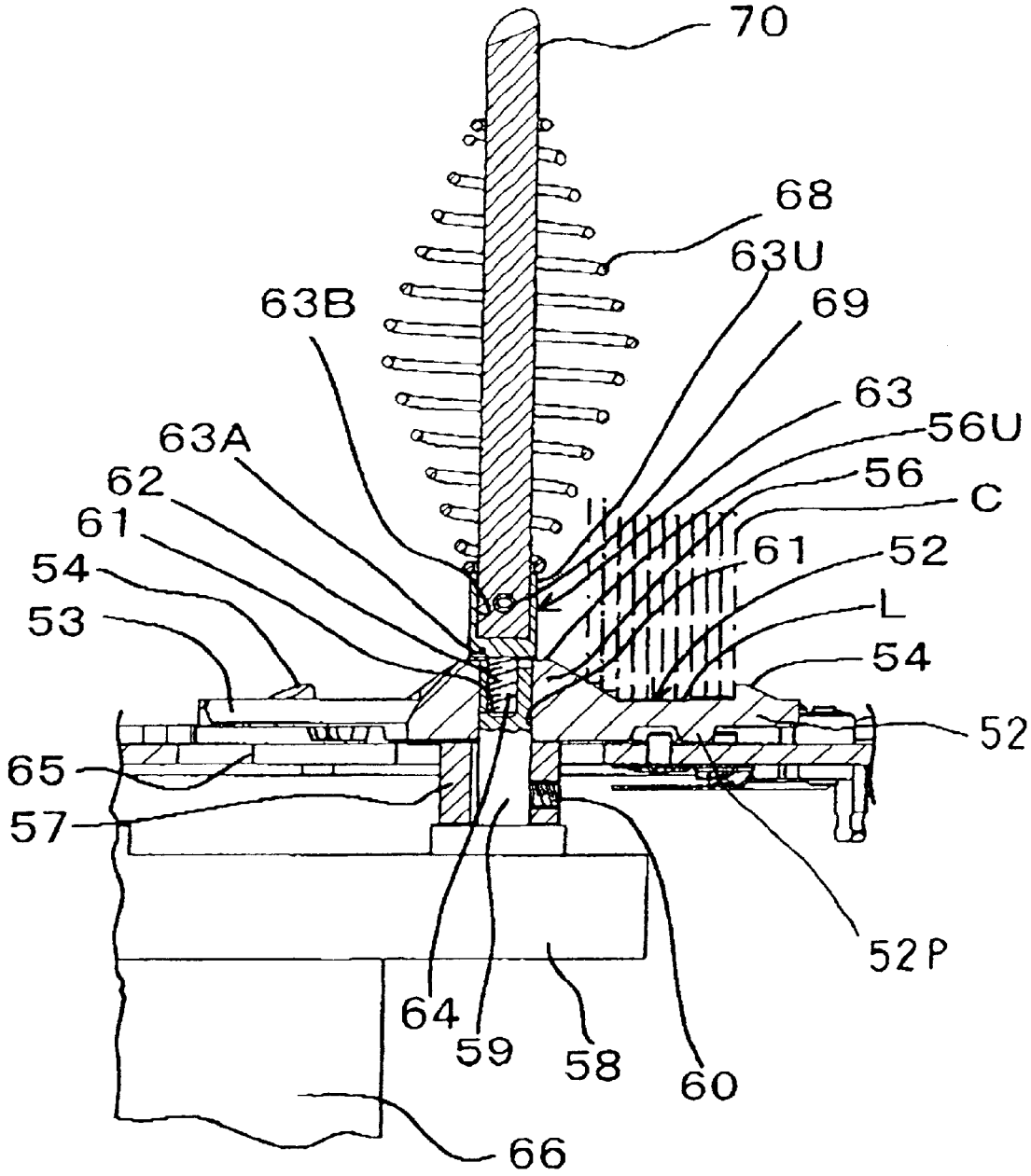
FIG. 10 is a sectional view in which an expanded main section of the device of FIG. 9 is shown.

In the first embodiment 1 (refer to FIG. 4), comparatively small coins were used. In the first embodiment coins with a diameter of about 25 millimeters were used. In a second embodiment (refer to FIG. 9), comparatively large coins are used. Coins having a diameter of about 30 millimeters were used in the second embodiment. Similarly, in a third embodiment 3 (refer to FIG. 11), comparatively large coins are used. Coins with diameter of about 30 millimeters were used in the third embodiment 3. In FIGS. 9 and 10, there are respectively shown a structure of coin hopper which is a second practical example according to this invention.

FIG. 9 is a perspective view which is shown by cutting a part of coin hopper 50 away. FIG. 10 is a sectional view in which an expanded main section of FIG. 9 is shown. A tank 51 of hopper 50 is of a generally pot shape (refer to FIG. 9). Upper part 51U of this tank has a large rectangular tubular shape. Lower part 51L of the tank has a smaller cylindrical shape. Tank upper part 51U and tank lower part 51L are integrally formed with an intermediate part 51M of a pot shape.

Disk 52 is located for rotation in small cylindrical tank lower part 51L. Upon rotating disk 52, a plurality of holes 53 for passing the coin are opened at regularly-intervals. It is of course that these coin passing holes 53 have diameters which are a little larger than the pay-out coin diameter. Coin-pass holes 53 are formed with a taper which becomes narrow in approaching the bottom from the top (refer to FIG. 10). A thin rib L is formed between adjacent coin-pass holes 53. A protrusion 54 for agitating is provided as a triangle-like structure projected on the upper surface of disk 52. On the upper surface at central part of rotating disk 52, mounting division 56 with a truncated cone state is formed. At a lower portion of FIG. 10 a collar 57 is shown. This collar 57 is fit on the output shaft 59 of speed reducer 58, and is fixed by means of press screw 60. Disk 52 is fit on the output shaft 59 of speed reducer 58, by intervening open hole 61 of mounting division 56. Rotating disk 52 is positioned on an upper surface of collar 57. The head of output shaft 59 has a screw hole 62. Within this screw hole 62, screw division 64 at the lower of mounting body 63 is fit. The upper part of mounting body 63 is formed in cylindrical with bottom. With this structure, rotating disk 52 is fixed on output shaft 59. Concretely, stage division 63A of mounting body 63 presses upper surface 56U of mounting division 56 and then fixes them. By this fixation, rotating disk 52 is located in a level state.

The outer diameter of the pipe with bottom 63U of mounting body 63 is smaller than the upper surface 56U of mounting division 56. At the underside of rotating disk 52, a convex section 52P for issuing the coin is formed. This convex sections 52P sends out a coin to a disposition mouth (not shown), by sliding the coin on base 65 which fell into the hole 53. A frame 67 at the lower portion on FIG. 9 supports the base 65. An electric motor 66 at the lower portion of FIG. 10 drives speed reducer 58. An elastic rod body 70 is shown at the upper portion of FIG. 10. A spiral coil spring 68 is supported on the rod body 70. A lower end of the rod body 70 is inserted into a hole with bottom 63B of mounting body 63, and is fixed by means of split pin 69. On the upper end of the elastic rod body 70, an upper end of the spiral coil 68 is fixed by tightening. A lower end of the spiral coil 68 is similarly fixed on lower the end of the rod body 70 by tightening. A large number of comparatively large coins may be placed in tank 51 in a loose condition. A plurality of the lowermost coins are positioned on rotating disk 52.

The operation of this second practical example is explained below.

At the start of operation the rotation of motor 66 causes the disk 52 to rotate at a desired speed. With this rotation, the coins which are put on disk 52 are stirred by protrusion 54 and spiral coil 68. By this agitation, coins fall into holes 53 respectively, when the coins on the holes 53 come to lie in a state parallel to disk 52. Coins which fall in hole 53 reach base 65. After this, the coin is sent out to the dispensing mouth, by being pushed by convex section 52P at the underside of disk 52. The spiral coil 68 is rotated with disk 52 (as they are connected together for rotation). A coin which invaded between winding of coil 68 is pushed up and is stirred. When a part of coin contacts the protrusion 54, a coin is issued and stirred by the rotation of protrusion 54. Like this, coins in tank 51 are compulsorily stirred. Using the hopper of second practical example, the dispensation of a comparatively large number of coins is efficiently out. Using the hopper of this practical example, in the case of large coins, the frequency of non-pay-out is remarkably decreased. The hopper of this practical example avoids a coin bridge and interlocking phenomenon which are reasons of non-pay-out, thereby providing an improvement in function.

As mentioned above and in this practical example, spiral coil 68 is rotated, integrating with disk 52. When a plurality of coins C stand on the rib L between adjacent holes 53, the coins may be rotated with disk 52 (refer to chain lines of FIG. 10). In such condition, it arises a phenomenon in which a coin train C lines up on disk 52 and closes holes 53. Also, between disk 52 and tank tube portion 51L (see FIG. 9), a plurality of coins C are sandwiched. Then, the plurality of coins C sandwiched act as a support rod, and the rotation of disk 52 may be stopped. Such interlocking phenomenon between disk 52 and tank tube portion 51L also rarely arises. In other words, if coin train does not arise on thin rib L, coin bridge and interlocking phenomenons will not happen. Further, when coins C stand up on disk 51, a coin C does not come into position between windings of spiral coil 68 (refer to FIG. 10). The standing coins C may be nudged by the circumference of spiral coil 68. However, since spiral coil 68 is used, the frictional force is small and a force which can shift the coin train C is not generated. Therefore, the coin train grows such that bridge and interlocking phenomenons may generate, as above-mentioned. Also, by extending a lower end of spiral coil 68, it is considered that the lower end is placed on the upper surface 56U of mounting division 56. In this case, the contact friction force with coin C is small also, a force which can shift coin C does not seem to arise.

Figure 11:
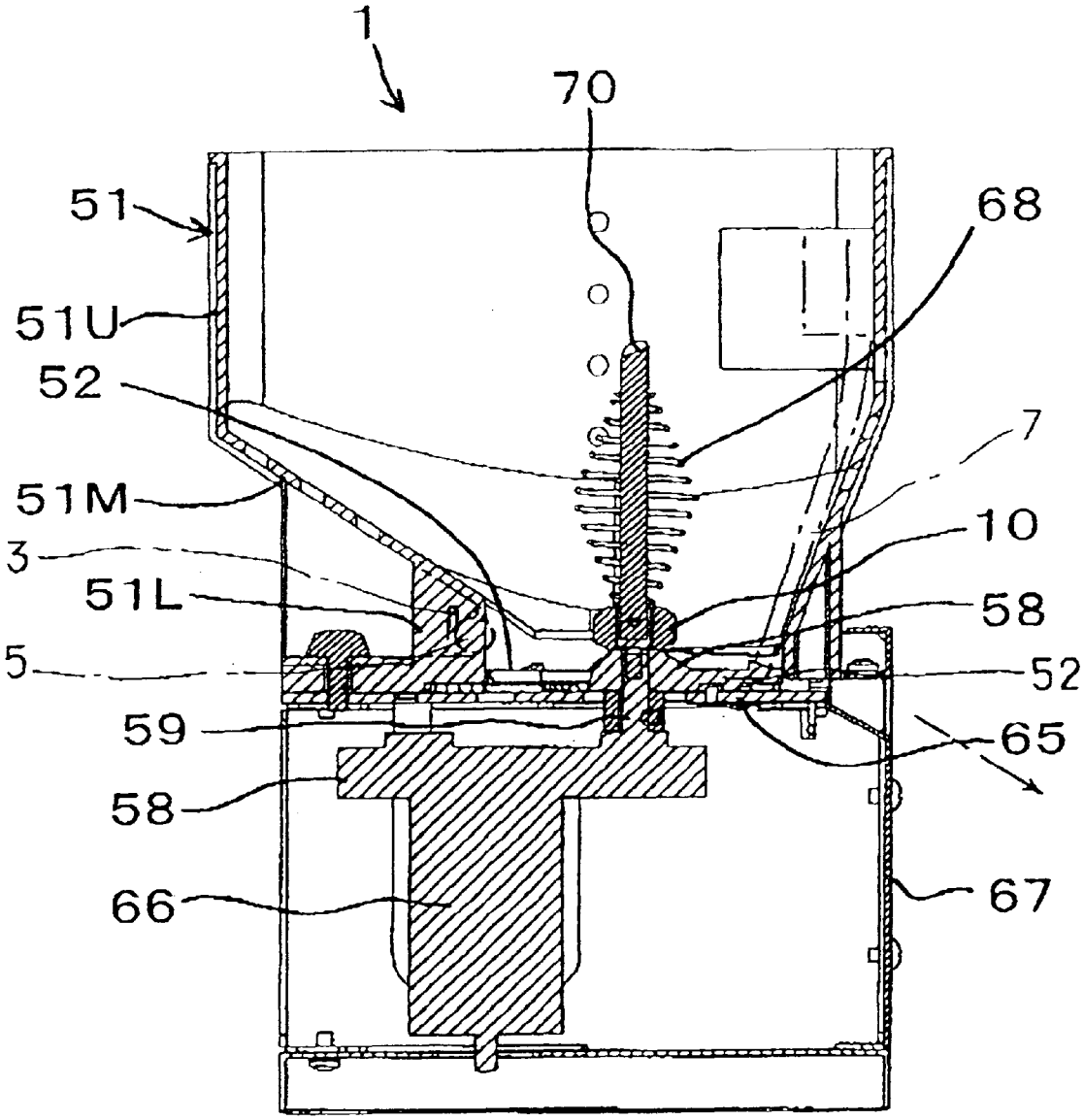
FIG. 11 is a sectional view which shows the a third embodiment according to the invention.
Figure 12:
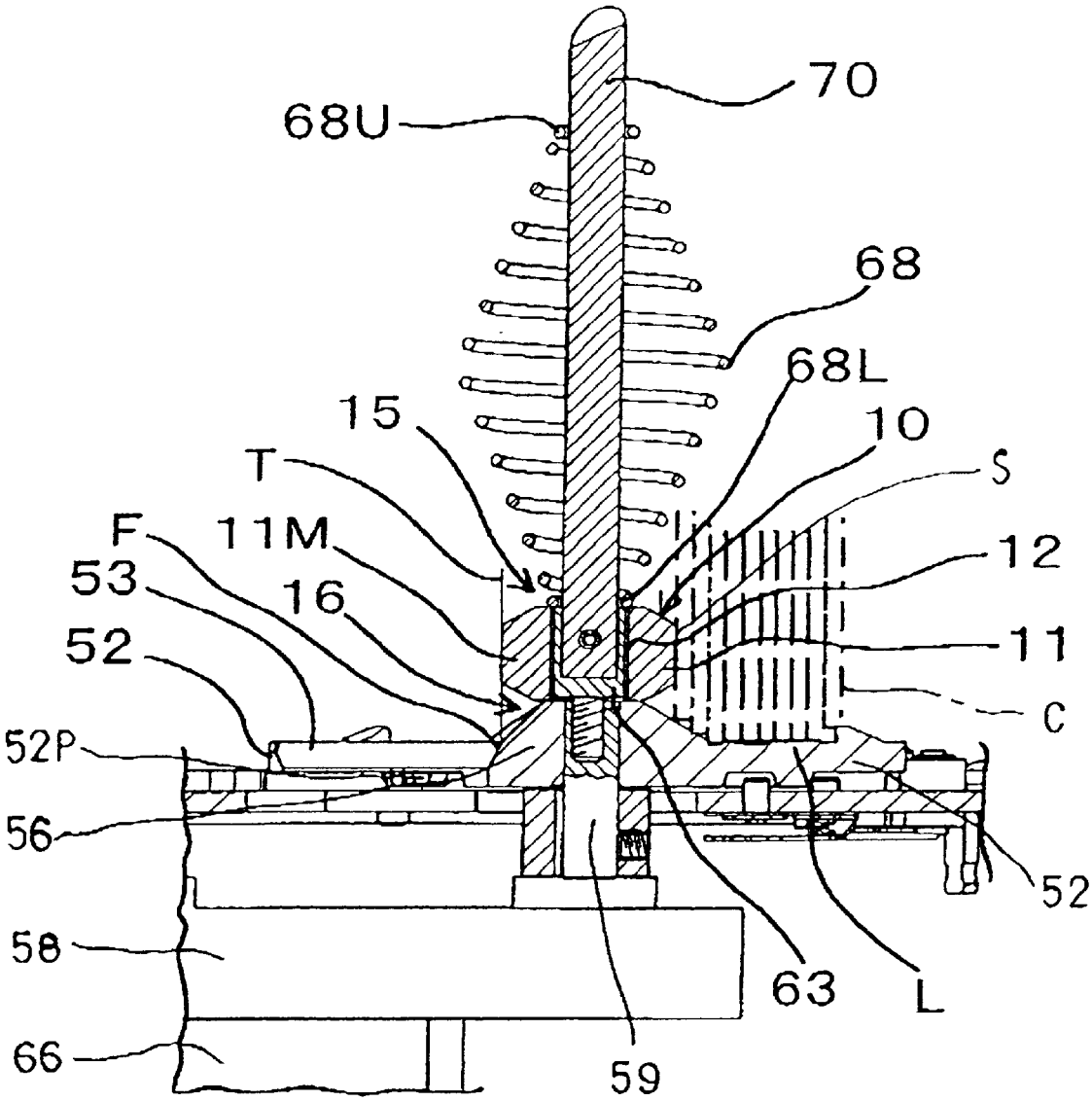
FIG. 12 is an enlarged sectional view which shows a main section of the device shown in FIG. 11.
Figure 13:
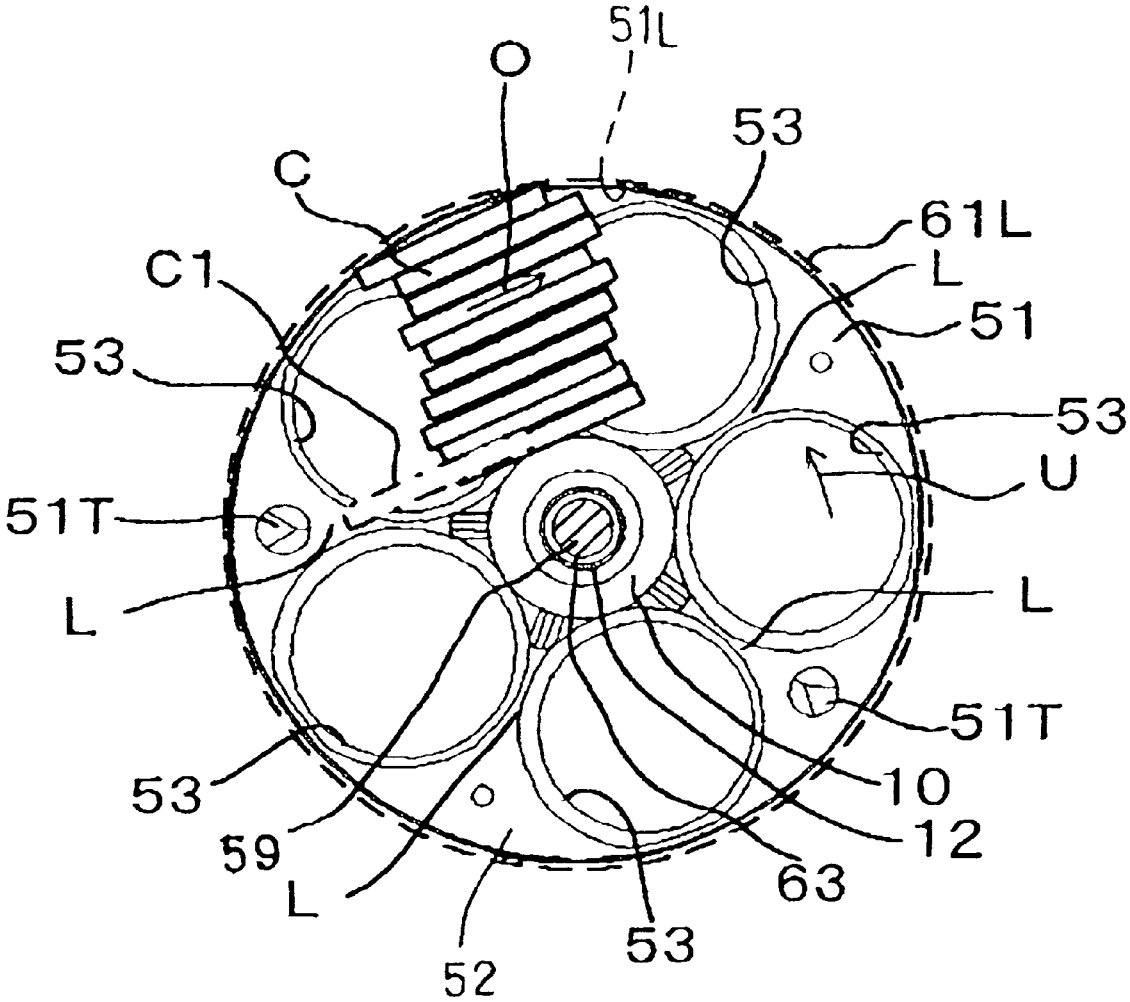
FIG. 13 is an explanatory view which observes FIG. 12 from the top.
Figure 14:
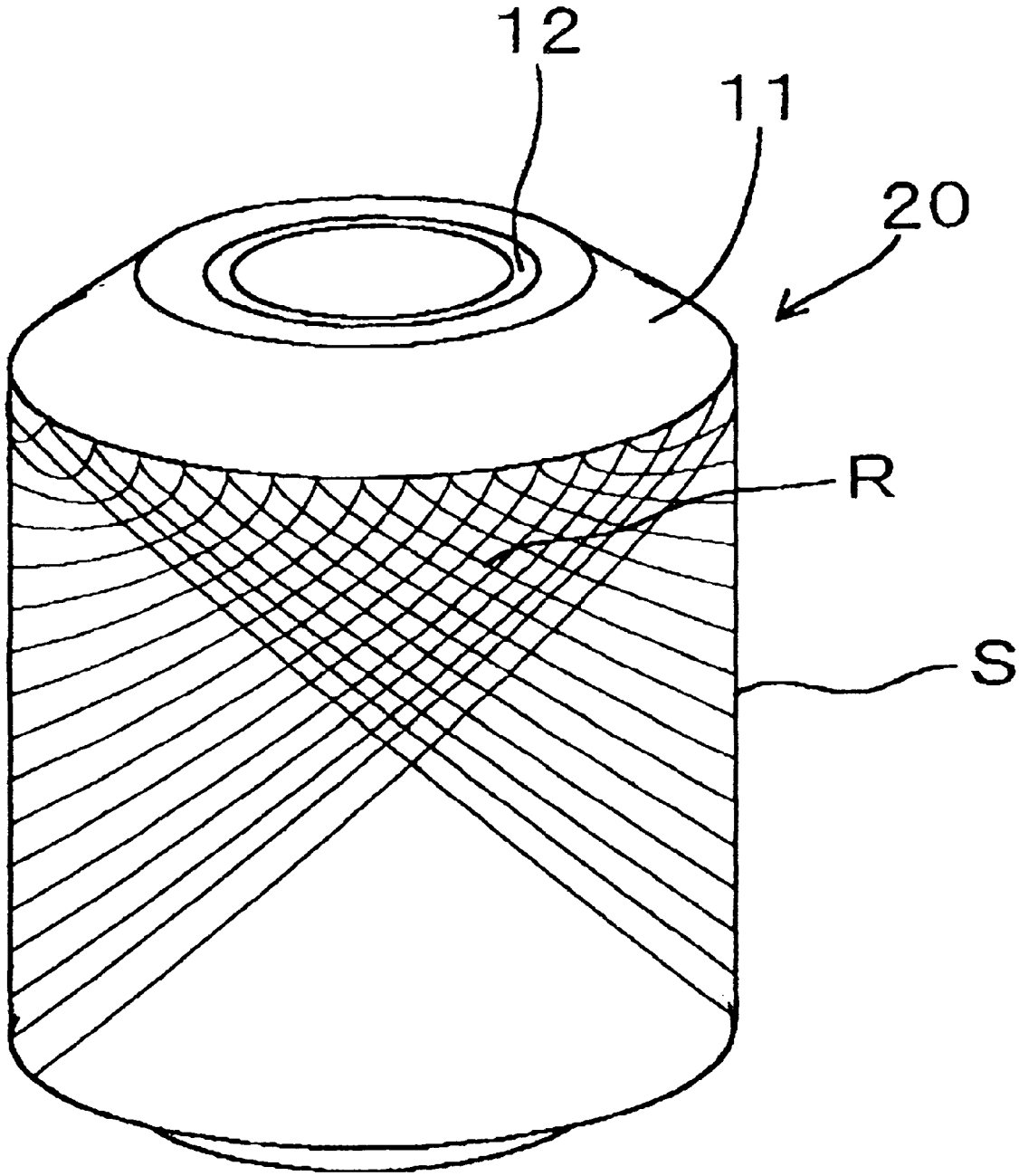
FIG. 14 is a perspective view which shows a second practical example of agitation body.
Figure 15:
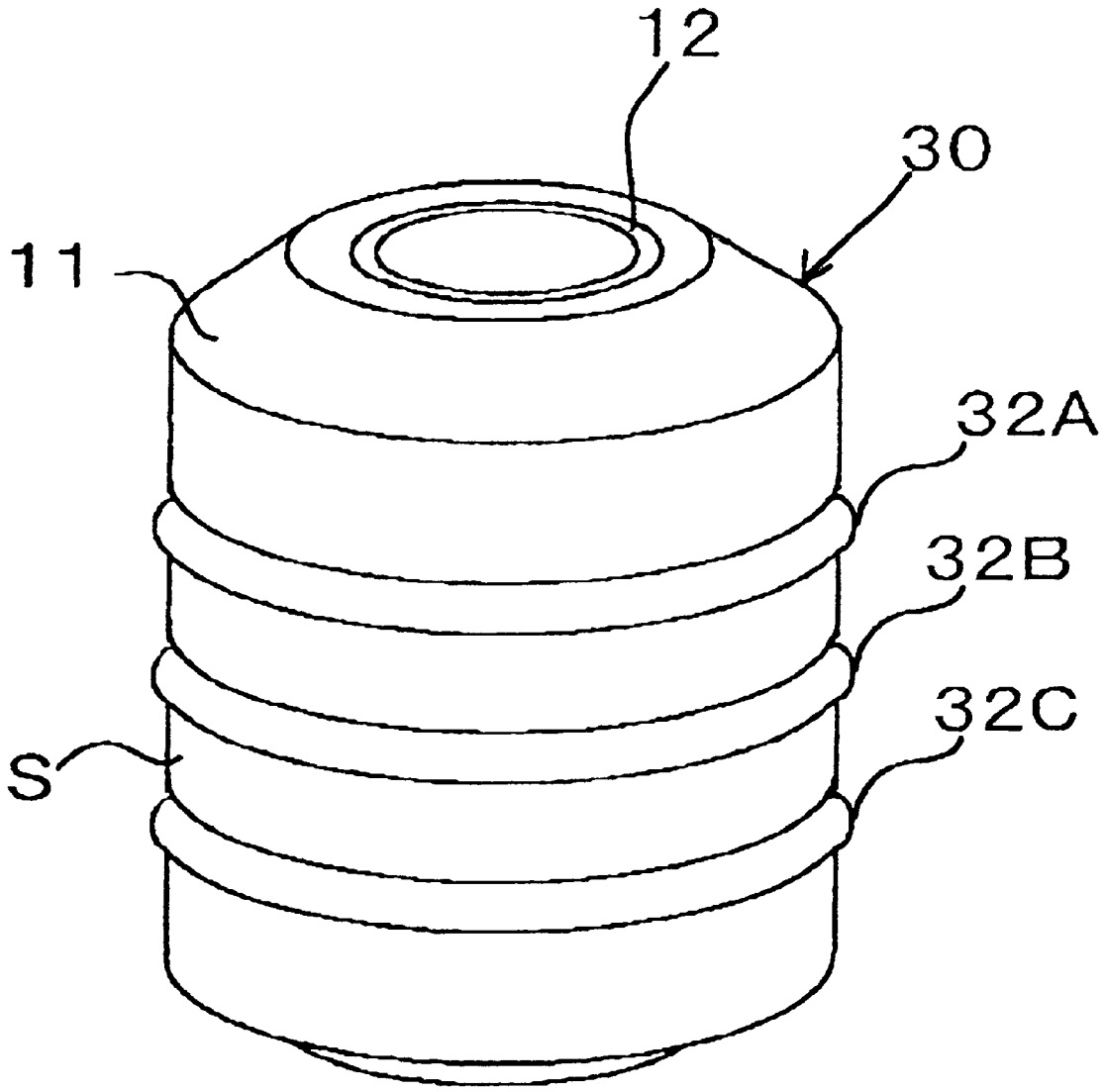
FIG. 15 is a perspective view which shows a third practical example of an agitation body.
Figure 16:
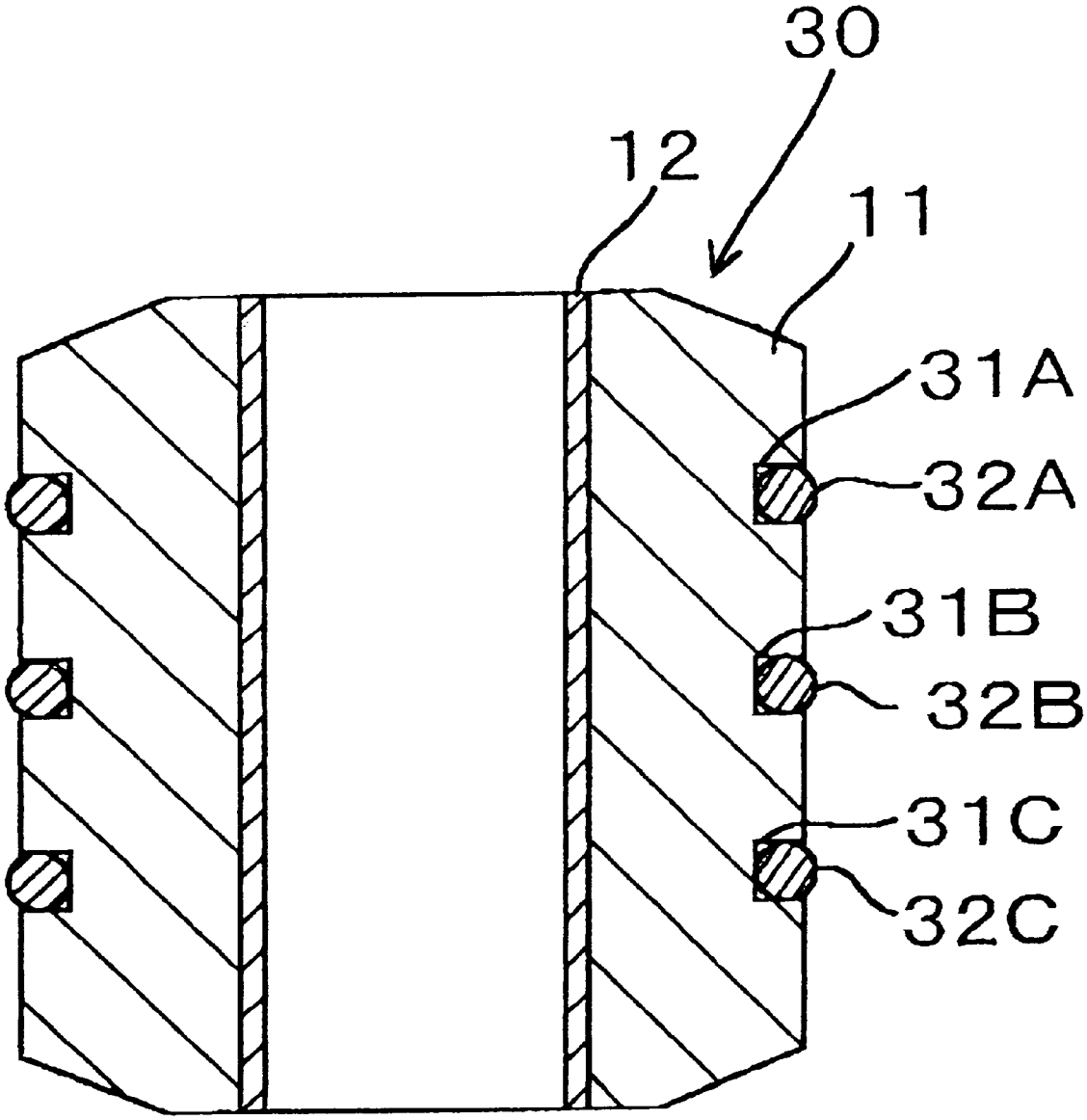
FIG. 16 is a sectional view which shows the third practical example of the agitation body.

FIG. 11 is a sectional view which shows the whole of a third practical example according to this invention. FIG. 12 is an enlarged section view which shows a main section of FIG. 11. FIG. 13 is an explanatory view which observes FIG. 12 from the top. FIG. 14 is a perspective view which shows a second practical example of agitation body. FIG. 15 is a perspective view which shows a third practical example of agitation body. FIG. 16 is a sectional view which shows the third practical example of agitation body. This third practical example according to this invention has been developed in order to solve further problems including some problems in the second embodiment. To begin with, on the interior wall of tank 51, an elastic rod 7 which is made of rubber is installed to trail on the disk 52 (refer to FIG. 13. 11). With this rod 7, the coin which is riding on the outer peripheral portion of disk 52 and turning with this disk is removed. In the tube portion 51L at bottom of tank 51, large tapered holes are opened from outside, and small balls 5 are freely rotatably embedded into the holes and pressed by means of springs 3 (refer to FIG. 11). Installing these balls 5, a plurality of coins are not sandwiched between disk 52 and tank tube portion 51L. Further, at the upper part of rotation axis of disk 52, agitation body 10 which is made of rubber is fixed (see FIG. 12). By the friction of rotating agitation body 10, the coin train and/or column on rib L between near holes 53 of disk 52 are destroyed. As this practical example is an improvement of second practical example, same reference numbers are used at same parts. Reference number 10 which is a ring shape at the center on FIG. 12 is an agitation body. Agitation body 10 consists of a friction body 11 which is formed a discus shape and a cylindrical bush 12 which is adhered to cavity division in friction body 11. Friction body 11 of FIG. 12 is made of polyurethane rubber. The top and bottom edges on friction body 11 are chamfered, and center circumference division 11M thereof is formed in a cylinder. The peripheral plane S on center circumference division 11M is parallel with rotation axis of disk 52, and has a width in a height direction. Bush 12 of agitation body 10 is freely rotatably fitted on mounting body 63. An upper end portion 68U of spiral coil 68 is pressed to be fixed on elastic rod body 70. A lower end portion 68L of spiral coil 68 is formed a little largely than the outer diameter of elastic rod body 70. Therefore, lower end portion 68L of coil can be moved up and down along elastic rod body 70. And, lower end portion 68L presses the upper surface of agitation body 10 by spring force of spiral coil 68. By this spring pressure, a frictional force is generated between lower end portion 68L of coil and upper surface of agitation body 10. Similarly and by this spring pressure, a frictional force is generated between upper surface of mounting portion 56 and underside of agitation body 10. Therefore, agitation body 10 is rotated around the mounting body 63, when an external force over a specified value (above a threshold) is applied thereto.

The lower end portion of spiral coil 68 and upper surface of agitation body 10 constitute a primary braking device 15. Also, the upper surface of mounting portion 56 and the underside of agitation body 10 constitute a second braking device 16. A peripheral plane S is located on perpendicular line T which extends from edge F of coin passing hole 53 near mounting portion 56 (refer to FIG. 12). It is of course advantageous that the position of peripheral plane S may be near the perpendicular line T. The length of horizontal direction of peripheral plane S is formed such that a coin center may contact thereto, when the coin C is standing on disk 52. It is also advantageous that the length of horizontal direction of periphery plane S is formed to be long, in order to correspond to a plurality of kinds of coins with different diameters.

Referring to FIGS. 11 to 13, operation of this practical example is explained below.

As with the second practical example, a plurality of coins C which contact disk 52 are issued, when the disk 52 is rotated. A part of the plurality of coins C are compulsorily pushed out and stirred by coin passing holes 53 and protrusions 51T. A part of plurality of coins C, which came into position between windings of spiral coil 68, are stirred by moving them to the upper part thereof.

When a plurality of coins C stand up and become a train on rib L of rotating disk 52, the coin contacts periphery plane S of agitation body 10 (see FIG. 13). In the meantime, the train of plurality of coins C which are standing up are rotated in an arrow U direction (FIG. 13), being integrated with disk 52. When the plurality of rotated coins contact the tube portion 5IL of tank 51, a force O which has the direction for stopping rotation is generated. Also, when the plurality of rotated coins contact other coin in stationary state, a force O which has the direction for stopping rotation is generated. Therefore, coin C1 which has contacted periphery plane S of agitation body 10 is moved by the frictional force of agitation body 10 (refer to chain lines of FIG. 13). On the other hand, other remaining coins C are left there by the rotation-stopping force O. As this result, one coin C1 disappears from the train of plurality of coins C. Therefore, freedom of movement of coins C in the train becomes higher, and the coin train is destroyed by force O which is applied to from the outside. Accordingly, there is no growth in the train of plurality of coins, and coin bridge and interlocking phenomenon are not generated.

When coin C1 is not moved by agitation body 10, a force which is over the specified value is applied to agitation body 10, intervening periphery plane S. When this force exceeds the braking forces of braking means 15 and 16, agitation body 10 is rotated around the mounting body 63 in the direction of arrow O. In other words, the slip will not be generated between agitation body 10 and coin C1 which are pressed strongly together. That is to say, the abrasion of agitation body 10 is prevented from occurring. The life will be prolonged, since the agitation body 10 is rotated. When the rotation of disk 52 is repeated, stationary coin C1 on disk 52 may be moved by timing. Next, a second practical example of agitation body shown on FIG. 14 are explained here. In agitation body 20, a pipe rod which is made of stainless steel material is used for friction body 11. In order to obtain a strong friction, knurling tool processing is carried out and small concaves and convexes R are formed on periphery plane S.

Even if metal material is used for this, the friction is strong by means of small concave and convexe portions R, when periphery plane S faces and contacts coin C1. Therefore, coin C1 of the coin train edge is accompanied with, in the similar way at first practical example of agitation body. Then, the abrasion is hardly generated, since friction body 11 is made of stainless steel metal. In order to increase the frictional force of periphery plane S, a star shape may be chosen, when friction body 11 is observed from the top.

FIGS. 15 and 16 show a third practical example of agitation body. Friction body 11 is formed by a pipe rod which is made of metal such as stainless steel. On periphery plane S, ring-shape grooves 31A, 31B and 31C are formed. Rings 32A, 32B and 32C which are made of polyurethane rubber are fitted into these grooves 31A to 31C. In the condition that rings 32A to 32C are fitted into grooves 31A to 31C, outer peripheral surfaces thereof are slightly projected from periphery plane S. When coin C1 is pressed, rings 32A to 32C are changed and come to the same level as the peripheral plane S, and then friction body 11 receives the pressure force. Accordingly, the friction becomes strong, since coin C1 is in face contact to rings 32A to 32C and periphery plane S. Thus, coin C1 is accompanied with, just like the primary practical example. Rings 32A to 32C are transformed, however, peripheral plane S of friction body 11 receives pressure force of coin C1. Therefore, it is advantageous that the wear amount decreases, even if slips occur. A cylindrical coil spring may be adopted by substituting spiral coil 68. Still, it is of course that a fiber-wound-spindle shape is desirable, since a stirring effect of coins which come to lie in a horizontal condition increases.

In a coin hopper which comprises a tank 51 with a pot shape for storing a plurality of coins; a disk 52 which is located in a horizontal position at the inner bottom of the tank and provided for freely rotating; and a hole 53 being opened in the disk and for passing the coins in horizontal state, it has been found that a stirring body 10 which is on the top surface of the disk and arranged on the turn center position of the disk has a big advantage or effect. These advantages occur even if bearing balls 5 are removed from the apparatus shown in FIG. 11. Similarly, it functions well even if elasticity stick or rod 7 is removed. Moreover, it the device operates well even if the spiral coil 68 and elasticity rod body 70 are removed.

Such an alternate embodiment is shown in FIG. 13 in which the stirring body 10 is made of relatively soft rubber, this stirring body can be fixed on the disk 52.

While specific embodiments of the invention have been shown and described in detail to illustrate the application of the principles of the invention, it will be understood that the invention may be embodied otherwise without departing from such principles.

What is claimed is:

1. A coin hopper to release coins one-by one, the hopper comprising:

a coin storage tank having a wall surface defining and surrounding a bottom opening in a bottom of said tank and a height of said wall surface defining the bottom opening having changes in level with a first wall surface portion and a second wall surface portion, said first wall surface portion having a lower height than said second wall surface portion and with an adjoining concave hopper bottom surface surrounding the bottom opening with a first bottom surface portion, a second bottom surface portion lower than said first surface portion and a sloping division surface arranged between said first surface portion and said second surface portion and a vertical surface surrounding said hopper bottom surface; and a rotary coin feeding disk disposed horizontally at the bottom of said tank and in said bottom opening of said tank, said disk being mounted freely rotatable.

2. A coin hopper according to claim 1, wherein said second wall surface portion is approximately one-twelfth of the length of the wall surface.

3. A coin hopper according to claim 1, further comprising a stirring body which is mounted on a top surface of said disk and is arranged on a turn center position of said disk, wherein said disk defines a hole forming a passage for passing coins in a horizontal state.

4. A coin hopper according to claim 1, wherein:

said wall surface defining and surrounding said bottom opening is substantially cylindrical about an axis substantially perpendicular to a plane of said bottom opening.

5. A coin hopper according to claim 4, wherein:

an axial length of said wall surface defining and surrounding said bottom opening varies around said bottom opening.

6. A coin hopper according to claim 1, wherein:

said wall surface defining and surrounding said bottom opening completely defines said bottom opening.

7. A coin hopper apparatus, the apparatus being configured to release coins therefrom one-by one, the coin hopper apparatus comprising:

a coin storage tank for loosely storing a plurality of coins, said coin storage tank having a top opening and a bottom opening in a bottom of said tank, said bottom opening being defined by a bottom opening wall surface and having a tank wall surface between said top opening and said bottom open wall surface, said tank wall surface including a vertical surface surrounding an inclined surface guiding the coins to said bottom opening with a first inclined surface portion, a second inclined surface portion lower than said first inclined surface portion and a sloping division surface arranged between said first inclined surface portion and said second inclined surface portion; and a rotary coin feeding disk disposed horizontally at the bottom of said tank and in said bottom opening of said tank, said disk being mounted freely rotatable, said bottom opening wall surface being substantially cylindrical with respect to an axis substantially perpendicular to a plane of said bottom opening and having a first wall surface portion and a second wall surface portion, said first wall sur portion having a lower height and lesser axial extent than said second wall surface portion.

* * * * *